United States Patent [19]

Soto

[11] 4,157,775

[45] Jun. 12, 1979

[54] APPARATUS FOR FORMING PLEATED MATERIALS

[76] Inventor: Enrique Soto, 1638 W. Washington Blvd., Los Angeles, Calif. 90007

[21] Appl. No.: 820,815

[22] Filed: Aug. 1, 1977

[51] Int. Cl.[2] ..... A41H 43/00

[52] U.S. Cl. ..... 223/34

[58] Field of Search ..... 223/28, 33, 34, 35; 33/174 G; 112/147, 148, 149; 93/60

[56] References Cited

U.S. PATENT DOCUMENTS

| | | | |
|---|---|---|---|
| 3,122,290 | 2/1964 | Mitchell | 223/28 |
| 3,297,215 | 1/1967 | Soto | 223/28 |
| 3,667,677 | 6/1972 | Sprong | 223/28 |
| 3,957,182 | 5/1976 | Sambus | 223/35 |

FOREIGN PATENT DOCUMENTS

| | | | |
|---|---|---|---|
| 1208864 | 10/1970 | United Kingdom | 223/28 |

*Primary Examiner*—Henry Jaudon

*Attorney, Agent, or Firm*—Albert M. Herzig; Edward C. Walsh

[57] ABSTRACT

Apparatus for use in fabricating pleated materials, particularly for forming pleats in drapery materials such as swags and cascades. The apparatus greatly facilitates and eliminates some certain hand operations. A plurality of parallel upstanding spaced members is provided. The members are connected by adjustable lazy tongs means so that the members are adjustable to a desired uniform spacing. The members may be either straight or they may be of curved configuration for making swags. The material is placed over the members and then uniform pleats are formed over the members with the pleats then being held to the members by holding devices. The members are constructed so that they can be manipulated or actuated to hold all the pleats which are then secured by stapling prior to the removal of the completed material and final fabrication.

11 Claims, 14 Drawing Figures

FIG. 1
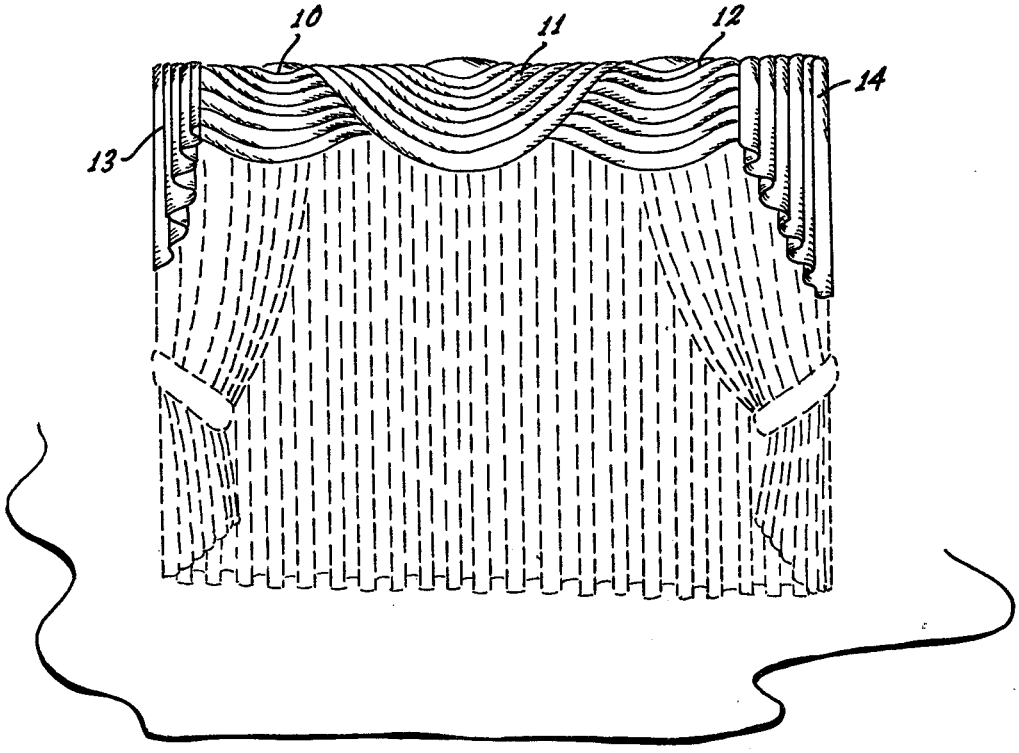
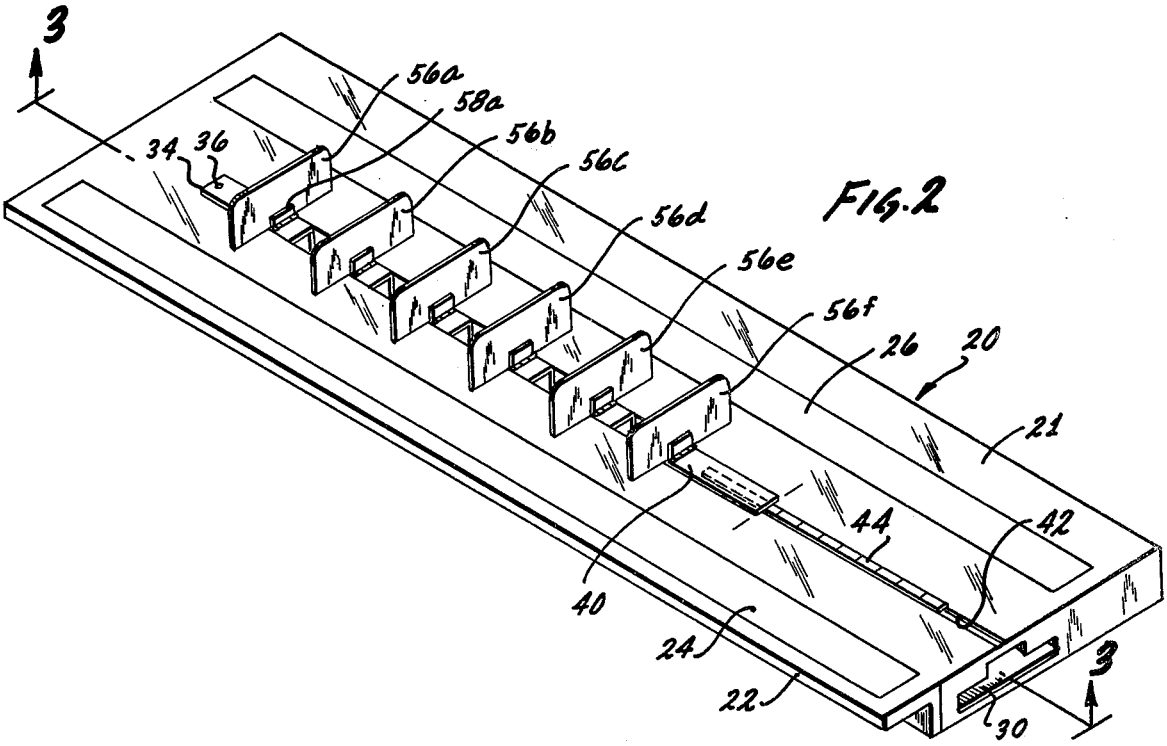
FIG. 2

FIG. 10
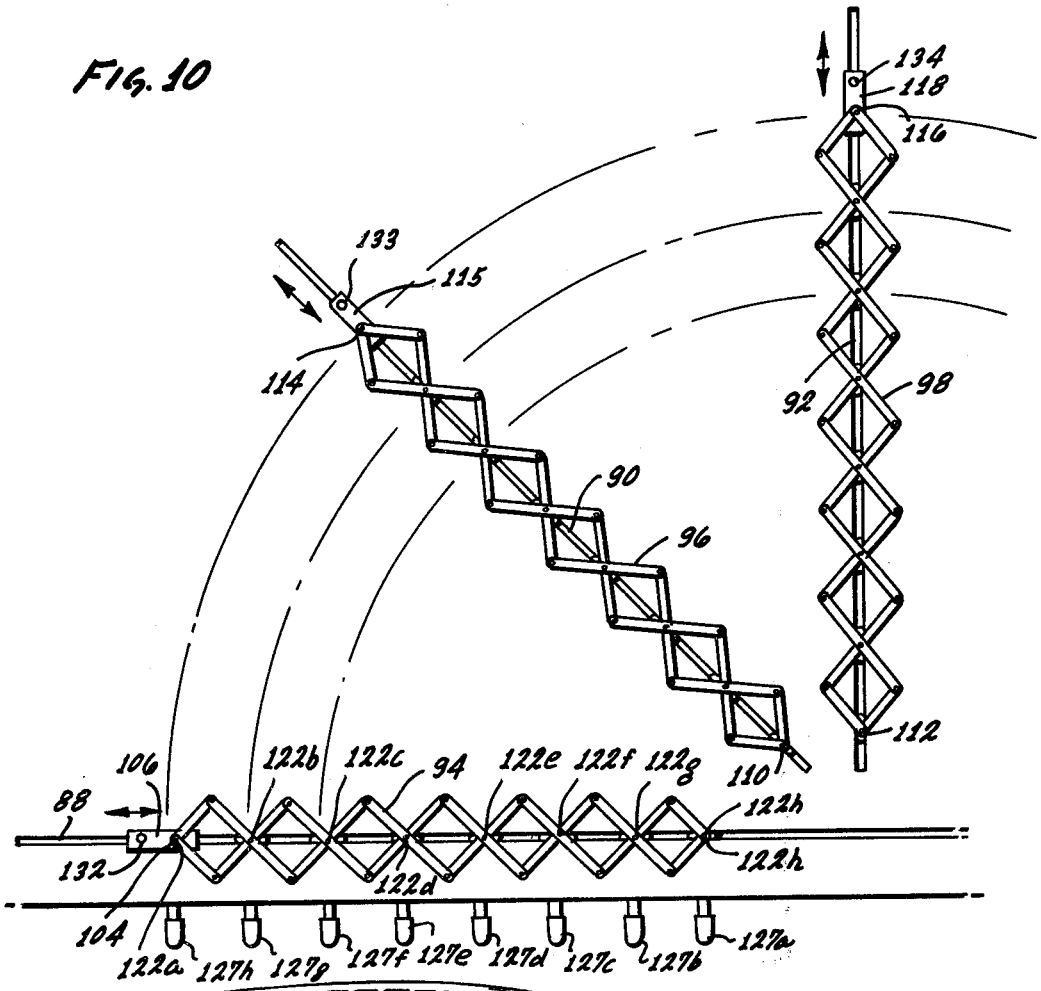
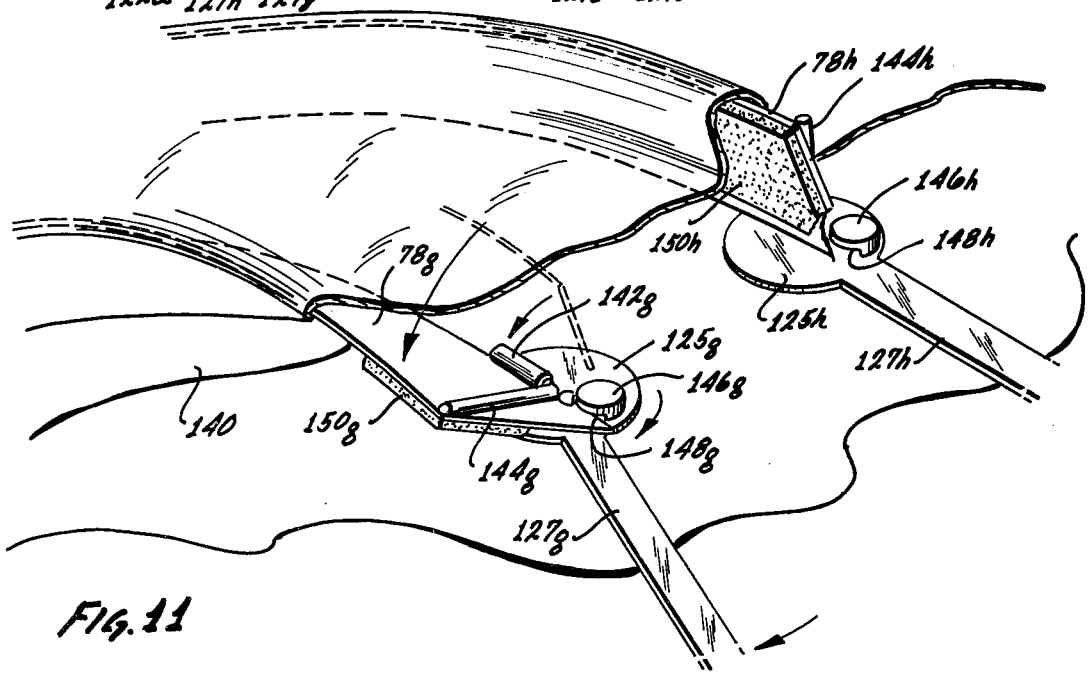
FIG. 11

APPARATUS FOR FORMING PLEATED MATERIALS

BACKGROUND OF THE INVENTION

1. Field of the Invention

The field of the invention is that of apparatus and techniques for forming pleats in material. The invention is particularly adapted for forming uniform pleats in drapery material especially in connection with the fabrication of drapery swags and cascades.

2. Description of the Prior Art

Reference is made to prior U.S. Pat. No. 3,297,215 of the herein inventor which is thought to be the closest prior art. The prior art patent is a machine for producing pleats in drapery material. The machine of the patent is one for use in the fabrication of swags or cascades and in this respect fulfills the need that exists for machines for reducing the hand operations presently required in the fabrication of these items.

SUMMARY OF THE INVENTION

Preferred exemplary forms of the invention are described in detail hereinafter. In a simplified exemplary form of the invention, a plurality of upstanding members are provided over which fabric material can be layed with folds or pleats being formed over the upstanding members. The members are in parallel relationship and are connected by lazy tongs means so that the members can be adjusted uniformly in their relative spacing. For making cascades, the material is laid over the upright members and folded over them to form the folds or pleats, the material being temporarily secured to the members by slotted elements that fit down over the fabric on the member. For making cascades, the upright members are straight and are hinged so that they can be laid over to hold the fabric temporarily while the edges are being cut and the pleats or folds are being stapled.

For fabricating swags, the upright members are made of flexible material and are curved to correspond to the desired curvature of the folds or pleats in the swag. A plurality of lazy tongs units or assemblies are provided in positions angularly spaced, for example 45° apart, with each of the parallel upright members being attached to spaced points of the lazy tong units. Thus, in a similar manner, the curved upright members can be uniformly adjusted in size and spacing. The fabric is laid over the upright members in a similar manner for purposes of making folds or pleats which can be held in a similar manner. Means are provided at the ends of the upright members for turning or laying them down for termporarily holding the fabric material while the folds or pleats are being stapled and the material is being cut to size.

In the light of the foregoing, the primary object of the invention is to realize, and to provide apparatus for reducing and simplifying hand operations normally required in connection with the formation and fabrication of fabric materials, more particularly, drapery material that is formed into swags and cascades.

A further object of the invention is to realize apparatus which includes upright parallel forming members with means preferably in the form of lazy tongs units for adjusting the members to desired uniform spacing with means for holding the fabric in association with the members after forming of the pleats and moving the members to hold the fabric while the pleats are being stapled or otherwise secured.

A further object is to realize apparatus as in the foregoing wherein the upright members are provided with a hinged mounting whereby they can be laid down or layed over to hold the fabric.

A further object is to provide apparatus as in the foregoing wherein the upright members are made of flexible material and have curved configuration, the members being attached at spaced angular positions to lazy tongs units to provide for adjustment in uniform spacing between the members, the swags being formed by forming folds or pleats over the parallel curved members.

A further object is to realize apparatus as in the foregoing wherein the curved members are provided with adjustable means at their ends for positioning the upright members to hold the folds or pleats being stapled or otherwise secured.

Further objects and additional advantages of the invention will become apparent from the following detailed description and annexed drawings.

BRIEF DESCRIPTION OF THE DRAWINGS

FIG. 1 is a pictorial view of a window provided with drapes, including swags at the top and cascades at the sides;

FIG. 2 is an isometric view of a preferred form of the invention;

FIG. 10 is a schematic view illustrating certain of the lazy tongs units of the device of FIG. 9;

FIG. 11 is a detailed view showing the devices at the ends of the upright members for folding them downwardly for holding the folds of fabric material;

DESCRIPTION OF THE PREFERRED EMBODIMENTS

Figure 3:
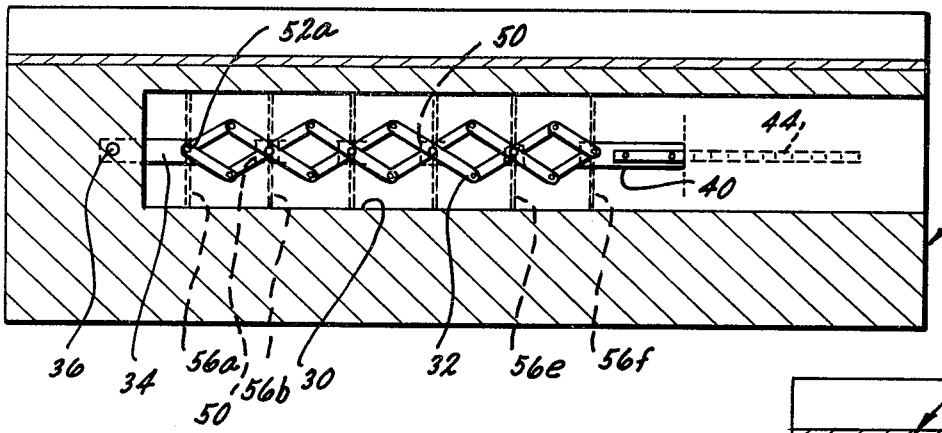
FIG. 3 is a bottom view of a form of the invention shown in FIG. 2.
Figure 4:
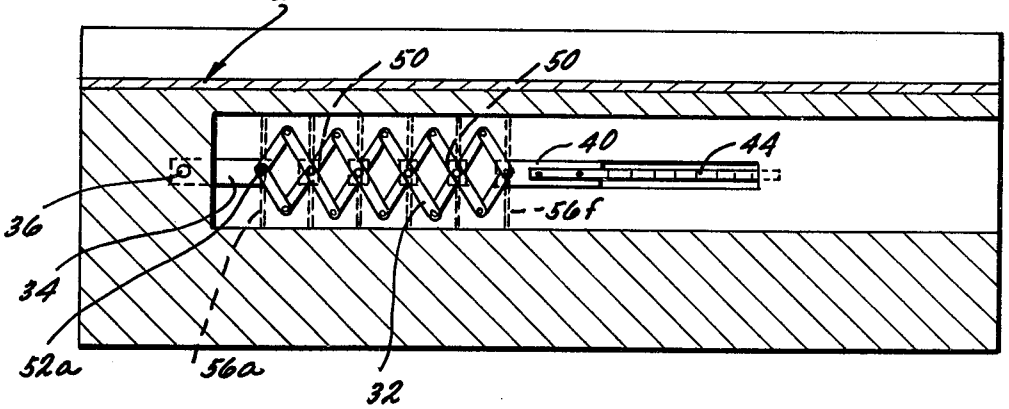
FIG. 4 is a view similar to that of FIG. 3 showing the lazy tongs in another position.

FIG. 1 is a pictorial view of a window having draperies which may be of typical appearance. The draperies include at the top, swags designated at 10, 11 and 12 which are fabric drapery materials having folds or pleats lying along curves which are parallel to each other as shown. At the sides of the swags, that is, at the upper corners of the windows, are cascades 13 and 14 which are made of fabric drapery material having vertical folds or pleats as shown, the lower ends of the cascades being along a slant or bias as shown.

The invention provides apparatus for purposes of forming or fabricating the swags and cascades of the type as shown in FIG. 1.

FIGS. 2–5 show a form of the invention particularly adapted for producing cascades. Numeral 20 designates a platform of rectangular configuration having an extending shelf 22 at one side. On the top surface 21 of the platform, there are secured flat metal strips 24 and 26 which may be made of aluminum or similar material. Graduated scales or rulers may be provided adjacent to strips 20 and 24.

The platform 20 has a longitudinal opening or recess in it having a cross-sectional shape as designated at 30 in FIG. 2. Within this recess or space is a lazy tongs unit designated at 32 in FIGS. 3–5. The lazy tongs unit is of typical construction comprising a plurality of crossed links pivoted to each other with the ends of the links pivotally attached to the ends of the links of an adjacent crossed pair. One end of the lazy tongs unit is attached to a metal strip 34 which is secured to the platform 20 by a rivet 36. The other end of the lazy tongs is attached to a metal strip 40 which can move over an elongated groove 42 in the platform 20 having in it a scale or ruler 44 having graduations so that the end of the piece 40 can be positioned adjacent a graduation to indicate an adjusted length of the lazy tongs unit. At the left end of the lazy tongs unit or assembly, as may be seen in FIG. 5, there is a bracket member 50 which has a portion 51 that is secured to the end of the lazy tongs by way of the pivot member **52*a*. It has an upper part 53 which is parallel to the top surface of the platform 20. Numeral 56*a* designates an upright plate member that is attached to the bracket portion 53 by way of a hinge 58*a* so that the plate 56*a*** can be rotated about the hinge into a substantially flat position.

Additional connecting pivots of the lazy tongs are identified by the numerals **52*b*, 52*c*, etc. Additional of the upstanding plate members are identified by numerals 56*b*, 56*c***, etc. See FIG. 2. Since these plates and their mountings are alike, they need not be described in further detail.

Figure 5:
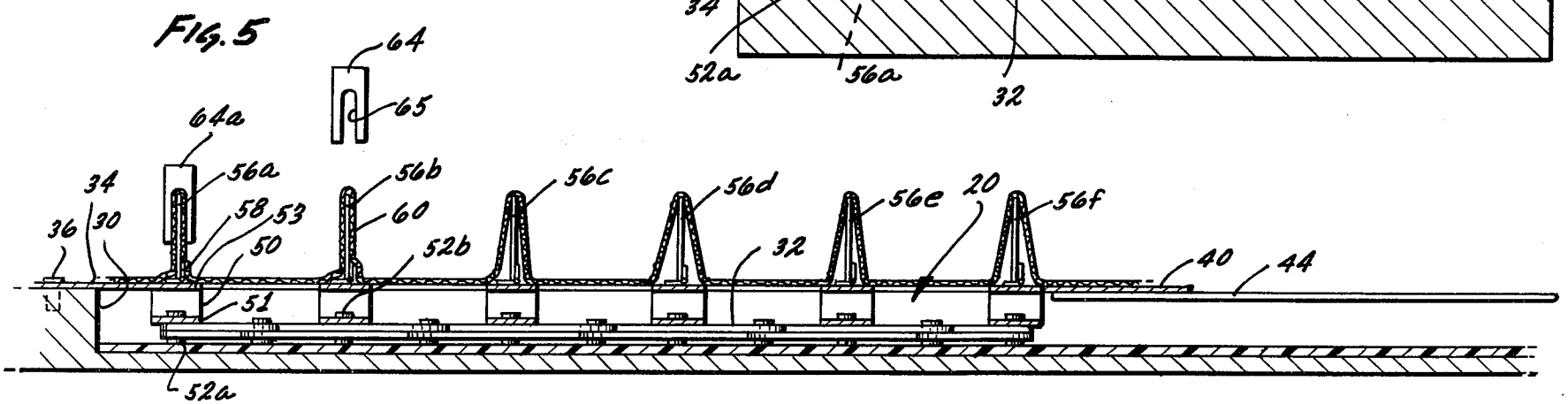
FIG. 5 is an enlarged sectional view of the form of the invention of FIGS. 2–4 illustrating the formation of the folds of pleats.
Figure 6:
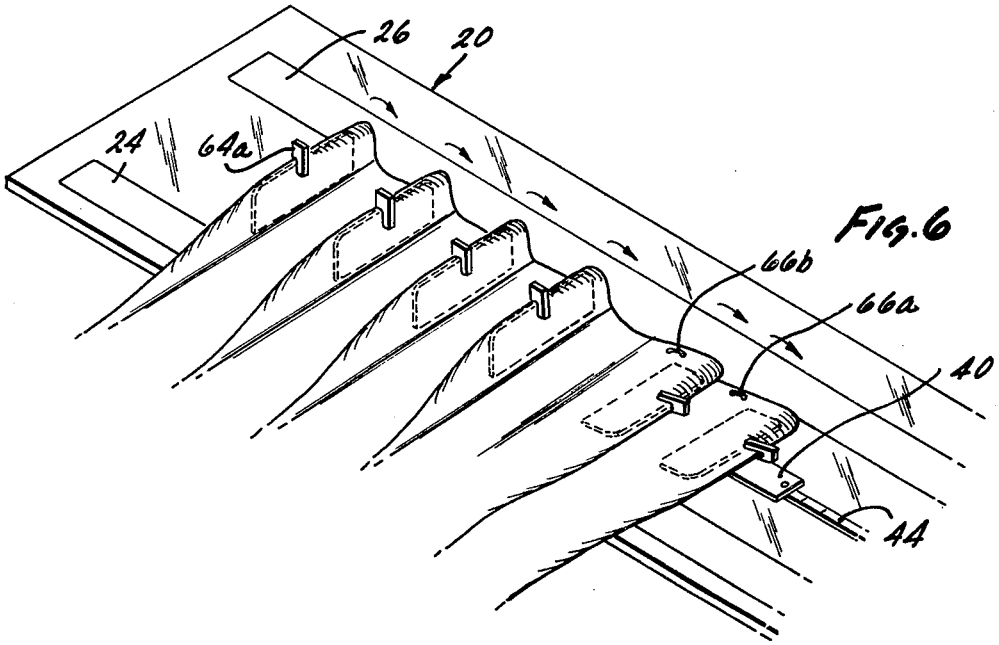
FIG. 6 is a pictorial view illustrating the formation of the folds or pleats, using the apparatus of FIGS. 2–5.
Figure 7:
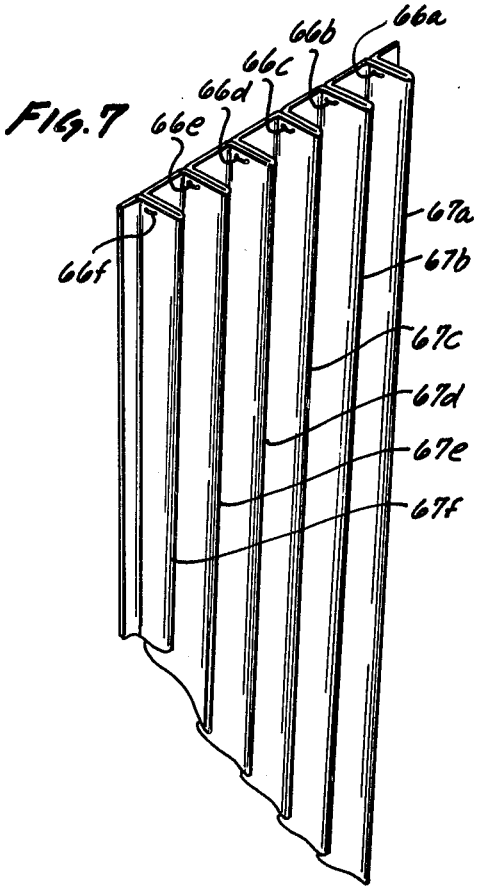
FIG. 7 is a view of a cascade being fabricated showing the folds staped together.
Figure 8:
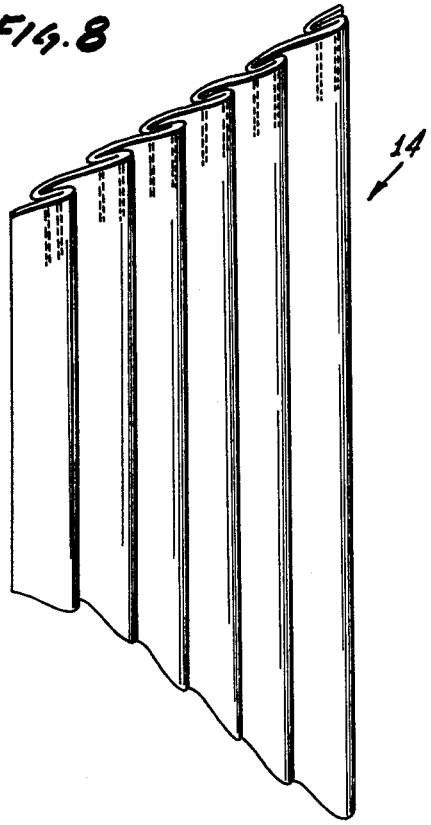
FIG. 8 is a partial view of one of the cascades of FIG. 1.
Figure 9:
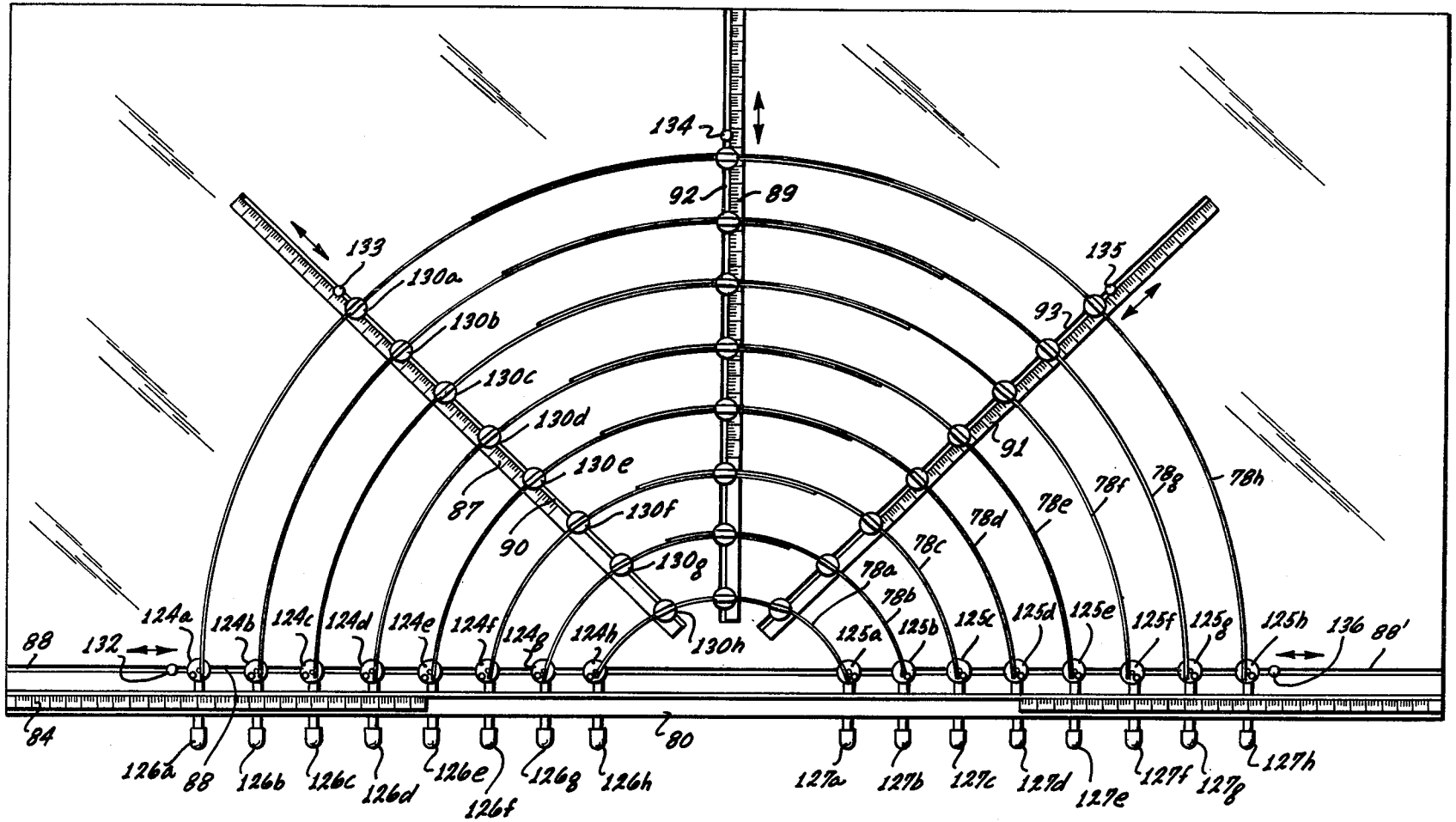
FIG. 9 is a plan view of another form of the invention which is for forming swags.

FIG. 5 illustrates the placement of the fabric material over the plates 56 for purposes of forming the cascade folds or pleats as further illustrated in FIGS. 6–8. FIGS. 6–8 further illustrate the technique of forming the folds in the fabric.

The upright spaced members 56 are first adjusted manually by adjusting them to a position in accordance with the desired spacing between folds or pleats. Preferably, rulers or graduated scales may be provided along the strips 24 and 26 so as to measure or gauge the spacing between plates. The fabric material is laid over the upright plate members and the folds are made by simply folding the fabric material against the sides of the upright members as illustrated in FIGS. 5 and 6. Numeral **64*a* designates a flat holder member that may be made of plastic or similar material which has a slot in it as designated at 65 so that this member may be fitted down over a plate with the fabric folded over the plate as illustrated in FIGS. 5 and 6. This member holds the folds in position while the cascade is being formed. After the pleats have been formed, as described, the plates 56 can be laid over, that is, moved about their hinges as illustrated in FIG. 6. When laid over in this manner, the folds or pleats are held in uniform configuration. In this position, folds or pleats are stapled at the ends as may be seen at 66*a* and 66*b* of FIG. 6. FIG. 7 shows a cascade that has been fabricated having folds or pleats 67*a*–67*f*, the ends being stapled as shown at 66*a*–66*f*. FIG. 8 illustrates one of the finished cascades 14** which is illustrated in FIG. 1, the cascade having been formed by the apparatus and technique as described.

From the foregoing, those skilled in the art will readily understand and appreciate how the apparatus greatly simplifies and reduces the manual operations normally required in fabricating cascades. Without the apparatus and technique as described, it is required that the operator make all measurements as necessary for purposes of making folds or pleats of the right size and with the correct spacing. By making measurements and by manually working the folds or pleats into the correct configuration and spacing, it can readily seen that the work is extremely tedious, demanding and time consuming with the results being questionable because of a lack of accuracy in the work.

FIGS. 9–14 show another form of the invention that is particularly adapted for fabricating swags. Preferably, the apparatus is constructed in rectangular form so that it can be placed on top of a table or the like, the apparatus having very limited vertical dimension or depth. FIG. 10 is a plan view of a preferred form of the invention. The apparatus embodies a rectangular structure having a flat upper surface or platform as designated at 76. On the surface of the platform are a plurality of curved or arcuate flexible members as designated at **78*a*–78*h***.

The members 78 may be made of relatively thin plastic material and may be constructed in sections having overlapping portions as may be seen at the intermediate parts of the arcs. These arcuate flexible members are in parallel relationship and they may or may not be arcs of a circle. Spacing between them is adjustable as will be described.

At the front of the platform is a strip 80 which overlies the surface of the platform 76 and at the right end of this strip is a ruler 82, and at the left end is a ruler 84. The ends of the upstanding arcuate members are attached to a locking handle as will described presently. The spaced relationship between the arcuate members 78 is maintained by a group of five lazy tongs units which are positioned beneath the surface of the platform 76. The ends of the arcuate members 78 are along a straight line and along this line is a slot 88 in the surface of the platform. There is a lazy tongs unit positioned under the left-hand part of the slot as designated at 88; a similar lazy tongs unit is underneath the right-hand part of the slot designated at 88'.

In the surface of the platform are three additional slots spaced at 45° angles as designated at 90, 92 and 93 and there is a lazy tongs unit positioned underneath each of these slots. The lazy tongs units are of conventional construction comprising units of links pivoted to form an X shape with the ends of the links of one unit pivotally attached to the ends of the links of an adjacent unit.

FIG. 10 illustrates schematically the three lazy tongs units associated with the slots 88, 90, and 92, these units being designated by the numerals 94, 96 and 98. There are lazy tongs units beneath slot 93 at 98 and beneath slot 88 as designated at 94. Unit 94 is fixed at its inner end as designated at 102; its left end is attached by a pivot member 104 to a member 106 which has a slider movable in the slot 88, which can be set by knob 132.

The inner end of the lazy tongs unit 96 is fixed at a point 110 and the inner end of lazy tongs 98 is fixed at a point 112. The outer end of the unit 96 is attached by pivot member 114 to a member 115 which has a slider which slides in the slot 90, and is settable by knob 133.

The outer end of the unit 98 is attached to a pivot member 116 to a member 118 which has a slider which slides in the slot 92 and is settable by knob 134. Guideways may be provided on the underside of the platform 76 in which the lazy tongs units themselves may be guided.

The pivot points of the link members of the lazy tongs unit 94 are designated by the numerals **122*a*–122*h*. See FIG. 1. The pivots 122*a*–122*h* extend through the slot 88 and carried on these pivots are disc members 124–124*h*. See FIG. 9. FIG. 10 shows the left-hand quadrant of the structure. The right-hand quadrant is the same so that the structure need not be described in detail. Numerals 126*a*–126*h* designate handles operative to rotate the discs 124*a*–124*h*. A similar group of handles is provided on the right-hand side of the machine, two of these being designated at 127*g* and 127*h* associated with discs 125*g* and 125*h***, the details of which will be described presently.

Pivots of the lazy tongs 96 which extend through the slot 90 carry a series of discs **130*a*–130*h* which carry brackets to which the arcuate members 78** extend so that the arcuate members move correspondingly to adjustments of the lazy tongs.

Lazy tongs 98 has its pivot members connected to the arcuate member 78 in the same manner. Similarly, the lazy tongs underlying the slot 93 has its pivot points connected to the arcuate members in a similar manner. Numerals 132, 133, 134, 135 and 136 designate adjustable knob lock members which can adjust the positions of the outer ends of the respective lazy tong units with respect to their operating slots. Extending along the slots 90, 92 and 93 are additional graduated scales or ruler members 87, 89 and 91.

As can be seen from the foregoing, by adjusting the lazy tong units inwardly or outwardly from the center, the size of the parallel arcs can be adjusted while keeping them in parallelism, and this adjustment is, of course, for the purpose of adjusting the size and depth of the swag to be fabricated.

FIG. 11 shows the right ends of two of the upright flexible members **78*g* and 78*g* and their associated discs 125*g* and 125*h* and clamping handles 127*g* and 127*h*. FIG. 11 shows fabric 140 overlying the members 78*g* and 78*h*. Referring to the disc 125*g*, it carries a hinge 142*g* having a hinge pin which includes a right angle arm 144*g*. On the disc 125*g* is a circular button 146*g* having an undercut forming a lip as designated at 148*g*. The construction of the disc associated part for the member 78*h* is the same. Carried on the inside of the end of the member 78*g* is a foam rubber pad 150*g* and on the end of the member 78*h* is a similar pad 150*h*. The end part of member 78*g* can be manually bent down as shown in FIG. 11. As illustrated in FIG. 11, when the handle 127*h* is rotated into a position in which the handle 127*g* is shown, the fabric is clamped by the pad 150. The lip 148*g* on disc 146*g* locks member 78*g* in clamped position. Instead of disc 146*g*, this may simply be a knob that frictionally locks under member 78*g*** to hold it. In this manner, pleats and folds after being made can be held clamped while being stapled.

Figure 12:
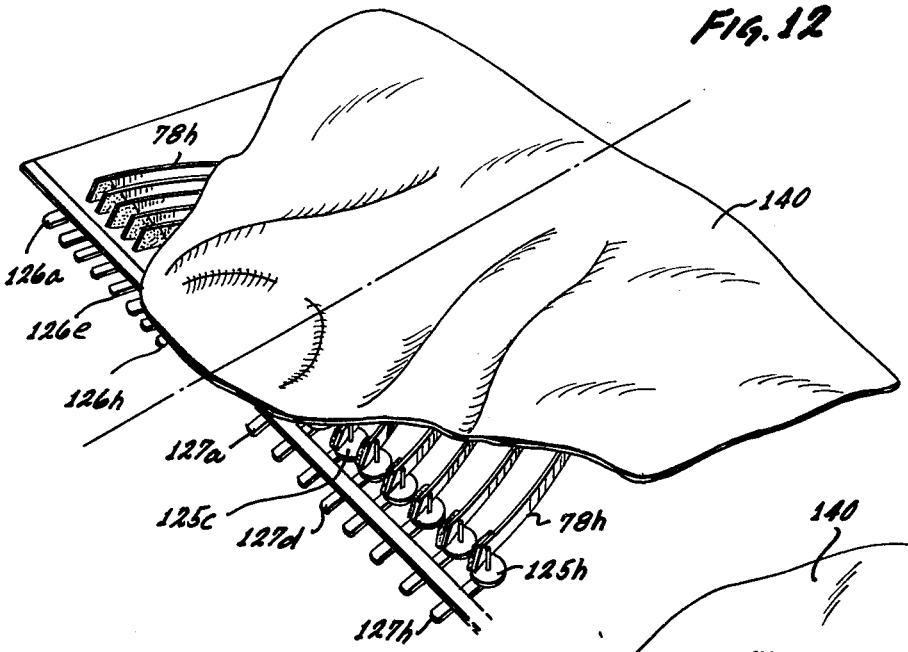
FIG. 12 is an illustrative view illustrating the placement of the fabric on the upright members.
Figure 13:
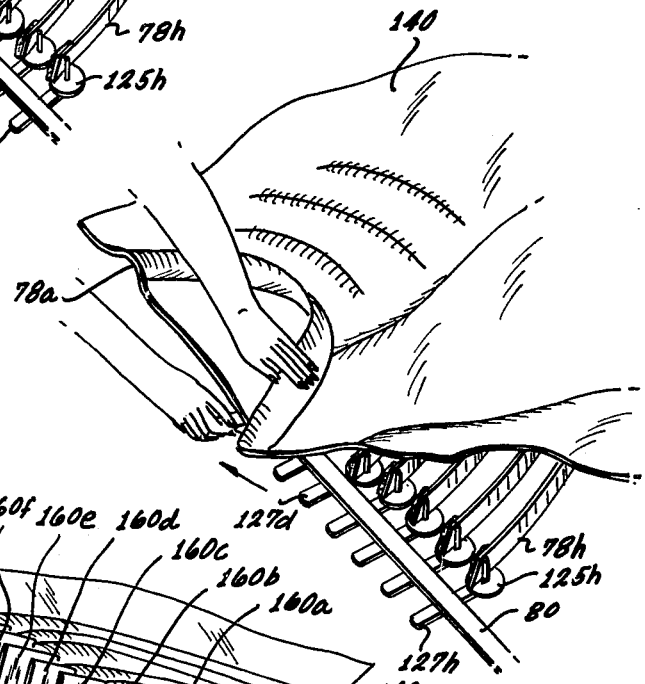
FIG. 13 is a further illustrative view illustrating the operation to hold the material in folded condition.
Figure 14:
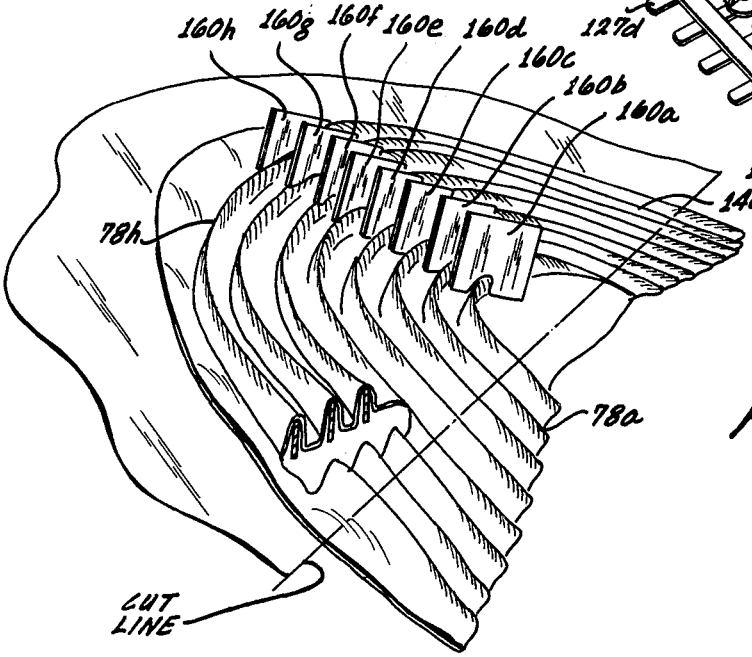
FIG. 14 is an illustrative view illustrating the elements used for holding the fabric in position over the upright members.

FIGS. 12–14 illustrate the technique of using the apparatus for fabricating swags. The right and left width adjustments or indicators, that is, knobs 132 and 136, are set to the desired finished width of the swag. The length or drop indicators are set by the adjustment knob locks 133, 134 and 135. The adjustable arcs are now set in parallelism to provide the desired parallel folds or pleats, with the set length or depth.

Precut fabric is now placed onto the apparatus right side up with the fabric covering the scissors cutting channel guide at the front of the platform. The center of the platform is preferably padded and is filled with fabric material. Preferably, a notch is made at the center of the fabric which is positioned covering the cutting guide slot and then the lower first clamp on the left and right, **126*h* and 127*a* to hold the fabric. These operations are illustrated in FIG. 14. Then the holding members as indicated at 160*a*–160*h* are placed over the folds and the upright arc members as the folds are made as illustrated in FIG. 14. These holding members are similar to the members 64*a*–64*h***. After all folds are made and secured, surplus fabric is cut off at the top of the swag by sliding a scissors along the cutting channel. Then the cut edges are stapled securing all the folds, or pins may be used. All the surplus fabric around the base of the swag, that is, the base of the outside adjustable arc, is cut off. The clips or holders may then be removed from the formed swag. Then all of the clamping handles may be released, releasing the folds from pressure and the swag may be removed from the machine. The swag is then ready for hemming and applying a tack strip. The tack strip will cover all of the staples holding the folds.

From the foregoing, those skilled in the art will readily understand the nature of the invention, its construction and the manner in which it is utilized to achieve and realize the objectives as set forth in the foregoing. It will be observed that the elements of the combination cooperate with each other in accordance with the invention in a manner such that a result is achieved that would not follow merely from association of the elements in a way other than that of the invention. Accordingly, there is a synergistic result stemming from the combination of the invention particularly as respects the hand operations that are eliminated and those that are simplified.

The foregoing disclosure is representative of preferred forms of the invention and is to be interpreted in an illustrative rather than a limiting sense, the invention to be accorded the full scope of the claims appended hereto.

What is claimed is:

1. Apparatus for forming equally spaced pleats or folds in fabric material of a type adapted to form a fall of material suspended from above, including in combination, a platform, means including a plurality of spaced members carried by the platform and upstanding therefrom, means connecting said members whereby they can be adjusted relatively to a desired predetermined relative spacing with respect to each other, thereby adapting the members to have the fabric material laid over them with material folded over the individual members to form spaced pleats in the material, and said first means including means constructed for holding the uniform pleats after being formed.

2. Apparatus as in claim 1, wherein the said parallel members are constructed to have a shape along the length of the members conforming to the shape along the length of individual pleats that may be desired.

3. Apparatus as in claim 2 wherein each of said spaced members includes hinge means whereby the member can be moved about the hinge toward the platform.

4. Apparatus as in claim 2, wherein the said members are constructed of relatively thin material, there being means for holding the members in parallel relationship.

5. Apparatus as in claim 4 wherein the said members are constructed of flexible material, there being means for holding the members in parallel relationship.

6. Apparatus as in claim 4, wherein the means for holding the said members includes lazy tongs means, the members each having predetermined points thereof attached to predetermined respective positions on the lazy tongs means whereby adjustments can be made in the spacings between the adjacent parallel members.

7. Apparatus as in claim 6 including means whereby individual members can be positioned for holding the material.

8. Apparatus as in claim 7 wherein said last means includes mechanism for folding at least a portion of an individual member toward the platform.

9. Apparatus for forming equally spaced pleats or folds in fabric material of a type adapted to form a fall of material suspended from above, including in combination, a platform, a plurality of spaced members carried by the platform and upstanding therefrom, means connecting said members whereby they can be adjusted relatively to a desired predetermined relative spacing with respect to each other, thereby adapting the members to have the fabric material laid over them with material folded over the individual members to form spaced pleats in the material, and means constructed for holding the uniform pleats after being formed, the said parallel members being constructed to have a shape along the length of the members conforming to the shape along the length of individual pleats that may be desired, the said members being constructed of relatively thin flexible material, there being means for holding the members in parallel relationship, the means for holding the flexible members including a plurality of lazy tongs units, each unit having a predetermined position with respect to the flexible members, the flexible members each having predetermined points thereof attached to predetermined respective positions on the lazy tongs units whereby adjustments can be made in the spacings between the adjacent parallel flexible members.

10. Apparatus as in claim 9 wherein said lazy tongs units include units attached to ends of the flexible members and units having angular positions relative to the end units, the angular positions being at substantially right angles to the flexible members.

11. Apparatus as in claim 10 including means for positioning said predetermined attached points whereby the members can be formed and secured in predetermined parallel curved configurations.

* * * * *